US005913408A

United States Patent [19]

Shanahan

[11] Patent Number: 5,913,408

[45] Date of Patent: Jun. 22, 1999

[54] UPPER BODY GARMENT WITH INCORPORATED FINGERLESS GLOVES

[76] Inventor: Thomas V. Shanahan, 376 Wellington Rd., Mineola, N.Y. 11501

[21] Appl. No.: 09/041,423

[22] Filed: Mar. 12, 1998

[51] Int. Cl.[6] ..... A41B 1/00

[52] U.S. Cl. ..... 2/90; 2/69

[58] Field of Search ..... 2/90, 69, 80, 85, 2/93, 94, 108, 105, 106, 115, 123, 125, 243.1, 269–271

[56] References Cited

U.S. PATENT DOCUMENTS

| | | | |
|---|---|---|---|
| 1,328,545 | 1/1920 | O'Shea | 2/90 |
| 1,356,168 | 11/1920 | O'Shea | 2/90 |
| 4,308,622 | 1/1982 | Maddron | 2/125 X |
| 4,756,027 | 7/1988 | Buenos et al. | 2/123 |
| 4,999,849 | 3/1991 | Grilliot et al. | 2/123 |
| 5,103,502 | 4/1992 | Grilliot et al. | 2/123 |
| 5,125,117 | 6/1992 | Buenos et al. | 2/123 X |
| 5,504,944 | 4/1996 | Bromer et al. | 2/125 X |
| 5,784,720 | 7/1998 | Mellon et al. | 2/125 |
| 5,794,265 | 8/1998 | Reich | 2/125 |

FOREIGN PATENT DOCUMENTS

| | | | |
|---|---|---|---|
| 1158637 | 6/1958 | France | 2/90 |

*Primary Examiner*—Gloria M. Hale

[57] ABSTRACT

A garment is provided including a long sleeve garment with an opening formed in at least one of the sleeves for allowing the removable placement of a thumb therethrough.

1 Claim, 2 Drawing Sheets

UPPER BODY GARMENT WITH INCORPORATED FINGERLESS GLOVES

BACKGROUND OF THE INVENTION

1. Field of the Invention

The present invention relates to upper body garments and more particularly pertains to a new upper body garment with incorporated fingerless gloves for selectively warming hands of a user without any loss of dexterity and without the use of separate gloves.

2. Description of the Prior Art

The use of upper body garments is known in the prior art. More specifically, upper body garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art upper body garments include U.S. Pat. No. 4,057,854; U.S. Pat. No. 5,282,277; U.S. Pat. Des. 271,154; U.S. Pat. Des. 247,526; U.S. Pat. Des. 247,331; and U.S. Pat. No. 5,312,667.

In these respects, the upper body garment with incorporated fingerless gloves according to the present invention substantially departs from the conventional concepts and designs of the prior art, and in so doing provides an apparatus primarily developed for the purpose of selectively warming hands of a user without any loss of dexterity and without the use of separate gloves.

SUMMARY OF THE INVENTION

In view of the foregoing disadvantages inherent in the known types of upper body garments now present in the prior art, the present invention provides a new upper body garment with incorporated fingerless gloves construction wherein the same can be utilized for selectively warming hands of a user without any loss of dexterity and without the use of gloves.

The general purpose of the present invention, which will be described subsequently in greater detail, is to provide a new upper body garment with incorporated fingerless gloves apparatus and method which has many of the advantages of the upper body garments mentioned heretofore and many novel features that result in a new upper body garment with incorporated fingerless gloves which is not anticipated, rendered obvious, suggested, or even implied by any of the prior art upper body garments, either alone or in any combination thereof.

To attain this, the present invention generally comprises a long sleeve upper body garment constructed entirely from a flexible, elastic material. The garment includes a central body portion having an open bottom and a neck opening. Each opening is lined with an elastic band, as shown in the Figures. Further included is a pair of long sleeves attached to the central body portion and extending therefrom. The sleeves terminate in open cuffs and are each lined with an elastic band. FIGS. 1 & 2 show a horizontally oriented slit formed in each of the sleeves just above the elastic band of the associated cuff. Each slit extends about a periphery of the sleeve about 1–1¼ inches. Further, each slit is situated adjacent to and faces the central body portion of the upper body garment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new upper body garment with incorporated fingerless gloves apparatus and method which has many of the advantages of the upper body garments mentioned heretofore and many novel features that result in a new upper body garment with incorporated fingerless gloves which is not anticipated, rendered obvious, suggested, or even implied by any of the prior art upper body garments, either alone or in any combination thereof.

It is another object of the present invention to provide a new upper body garment with incorporated fingerless gloves which may be easily and efficiently manufactured and marketed.

It is a further object of the present invention to provide a new upper body garment with incorporated fingerless gloves which is of a durable and reliable construction.

An even further object of the present invention is to provide a new upper body garment with incorporated fingerless gloves which is susceptible of a low cost of manufacture with regard to both materials and labor, and which accordingly is then susceptible of low prices of sale to the consuming public, thereby making such upper body garment with incorporated fingerless gloves economically available to the buying public.

Still yet another object of the present invention is to provide a new upper body garment with incorporated fingerless gloves which provides in the apparatuses and methods of the prior art some of the advantages thereof, while simultaneously overcoming some of the disadvantages normally associated therewith.

Still another object of the present invention is to provide a new upper body garment with incorporated fingerless gloves for selectively warming hands of a user without any loss of dexterity and without the use of gloves.

Even still another object of the present invention is to provide a new upper body garment with incorporated fingerless gloves that includes a long sleeve garment with an opening formed in at least one of the sleeves for allowing the removable placement of a thumb therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
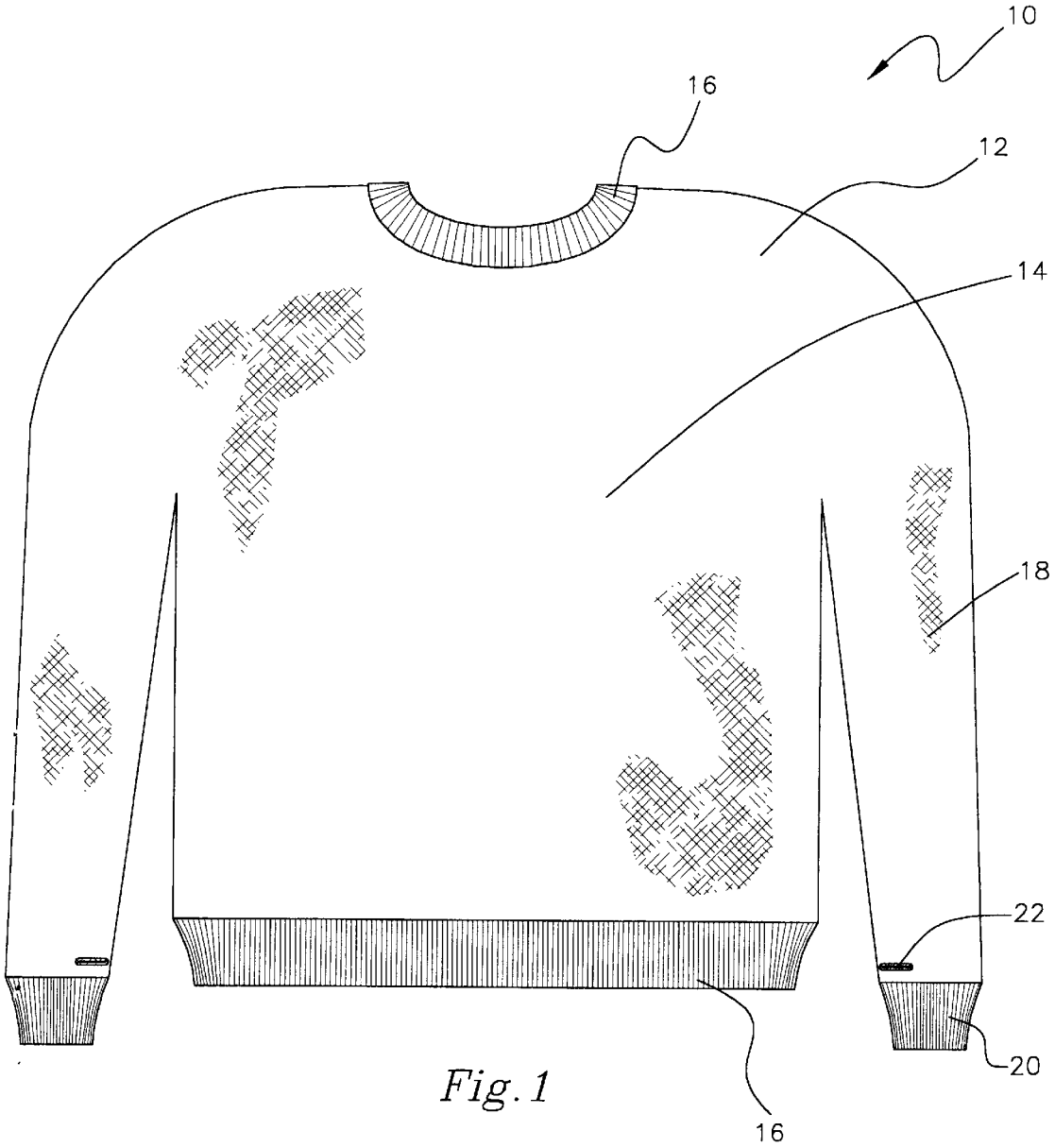
FIG. 1 is a front view of a new upper body garment with incorporated fingerless gloves according to the present invention.
Figure 2:
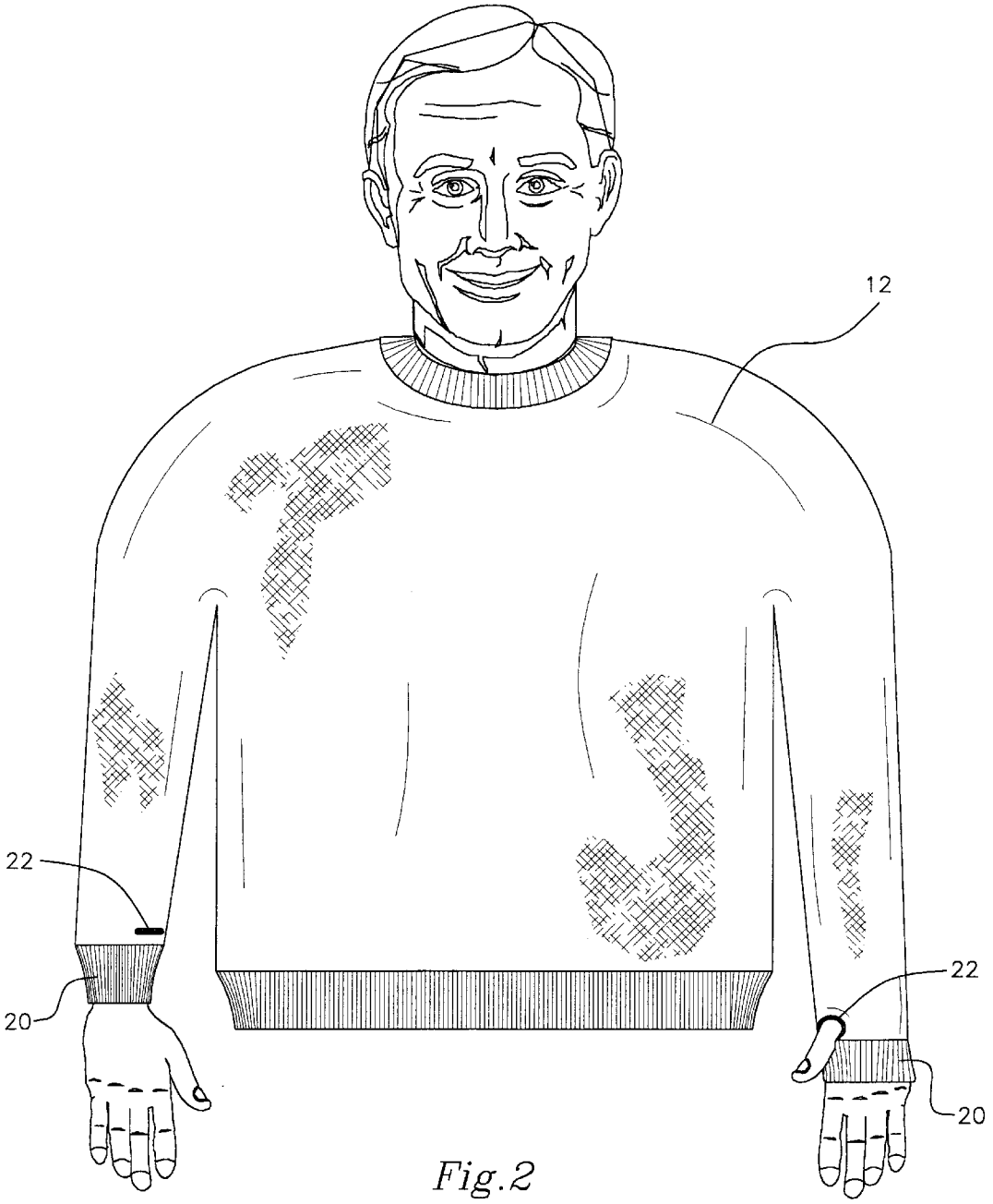
FIG. 2 is another front view of the present invention in use.

With reference now to the drawings, and in particular to FIGS. 1 through 2 thereof, a new upper body garment with incorporated fingerless gloves embodying the principles and concepts of the present invention and generally designated by the reference numeral 10 will be described.

The present invention, designated as numeral 10, includes a long sleeve upper body garment 12 constructed entirely from a flexible, elastic material. The garment includes a central body 14 portion having an open bottom and a neck opening. Each opening is lined with an elastic band 16, as shown in the Figures. Further included is a pair of long sleeves 18 attached to the central body portion and extending therefrom. The sleeves terminate in open cuffs and are each lined with an elastic band 20. For reasons that will become apparent hereinafter, the elastic bands associated with the open cuffs may be lined with a rubber material as an option.

FIGS. 1 & 2 show a horizontally oriented slit 22 formed in each of the sleeves just above the elastic band of the associated cuff. Each slit extends about a periphery of the cuff about 1–1¼ inches. Further, each slit is situated adjacent to and faces the central body portion of the upper body garment. Further, it should be noted that the slits are preferably reinforced with heavy duty peripheral stitching or the like.

In terms of dimensions, the neck opening preferably has a diameter of about 5–7 inches and the sleeves are about 21–22 inches in length. Further, the elastic bands associated with the cuffs are 2–3 inches in length. The central body portion preferably has a width of 24–27 inches and a length of about 27–29 inches. It should be noted that the inherent ratios and proportions of the foregoing measurements are critical in manufacturing garments of different sizes.

In use, the long sleeves have a first orientation with thumbs of a user being removably situated within the associated slits. As such, a bottom peripheral edge of the elastic band of the corresponding cuff resides level with a first set of knuckles of the user. See FIG. 1. The long sleeves further have a second orientation with thumbs of a user being removed from within the associated slit such that a bottom peripheral edge of the elastic band of the corresponding cuff resides level with a wrist of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment with extendible sleeves comprising, in combination:

a long sleeve upper body garment constructed entirely from a flexible, elastic material and including a central body portion having an open bottom and a neck opening each being lined with an elastic band and a pair of long sleeves attached to the central body portion and extending therefrom and terminating in open cuffs each lined with an elastic band comprising a rubber material, wherein the open cuffs have a length between about 2–3 inches;

a horizontally oriented slit formed in each of the sleeves closely adjacent the elastic band of the associated cuff, each slit extending about a periphery of the sleeve about 1–1¼ inches, each slit further being situated adjacent and facing the central body portion of the upper body garment, wherein each horizontally oriented slit is reinforced with stitching;

wherein the long sleeves have a first orientation with thumbs of a user being removably situated within the associated slits such that a bottom peripheral edge of the elastic band of the corresponding cuff resides level with a first set of knuckles of the user and a second orientation with thumbs of a user being removed from within the associated slit such that a bottom peripheral edge of the elastic band of the corresponding cuff resides level with a wrist of the user.

* * * * *